US007507154B1

(12) United States Patent
D'Avanzo

(10) Patent No.: US 7,507,154 B1
(45) Date of Patent: Mar. 24, 2009

(54) ELECTRONIC GAMING MACHINE

(75) Inventor: Scott D'Avanzo, Ladera Ranch, CA (US)

(73) Assignee: Adrenalin Gaming, LLC, Ladera Ranch, CA (US)

( * ) Notice: Subject to any disclaimer, the term of this patent is extended or adjusted under 35 U.S.C. 154(b) by 837 days.

(21) Appl. No.: 10/843,795

(22) Filed: May 11, 2004

Related U.S. Application Data

(63) Continuation-in-part of application No. 10/603,499, filed on Jun. 24, 2003, now abandoned.

(51) Int. Cl.
*A63F 9/24* (2006.01)

(52) U.S. Cl. ..... 463/16; 463/30

(58) Field of Classification Search ..... 463/16–22, 463/25, 30; 273/138.1, 143 R, 144 B, 269, 273/317.1, 457
See application file for complete search history.

(56) References Cited

U.S. PATENT DOCUMENTS

| | | | | | |
|---|---|---|---|---|---|
| 4,871,171 | A | | 10/1989 | Rivero | |
| 5,360,214 | A | | 11/1994 | Harmen | |
| 5,380,007 | A | * | 1/1995 | Travis et al. | 463/18 |
| 5,823,874 | A | | 10/1998 | Adams | |
| 5,848,932 | A | | 12/1998 | Adams | |
| 5,882,261 | A | | 3/1999 | Adams | |
| 6,089,978 | A | | 7/2000 | Adams | |
| D431,843 | S | | 10/2000 | Seelig et al. | |
| 6,159,097 | A | | 12/2000 | Gura | |
| 6,334,814 | B1 | | 1/2002 | Adams | |
| 6,338,678 | B1 | * | 1/2002 | Seelig et al. | 463/17 |
| 6,358,146 | B1 | | 3/2002 | Adams | |
| 6,394,901 | B1 | * | 5/2002 | Marta | 463/20 |
| 6,450,884 | B1 | | 9/2002 | Seelig et al. | |
| D470,539 | S | | 2/2003 | Seelig et al. | |
| 6,533,660 | B2 | | 3/2003 | Seelig et al. | |
| 6,860,809 | B2 | * | 3/2005 | Seelig et al. | 463/16 |
| 2002/0065126 | A1 | | 5/2002 | Miller et al. | |

* cited by examiner

*Primary Examiner*—Dmitry Suhol
*Assistant Examiner*—Robert Mosser
(74) *Attorney, Agent, or Firm*—Greenberg Traurig

(57) ABSTRACT

A gaming machine having a secondary game comprising either a physical or video depicted blender is disclosed. Ice cubes having values or symbols incorporated thereon define a bonus award. In the video embodiment, a display shows an operating blender causing a lid to dislodge allowing an ice cube to be ejected. The value depicted on the ejected ice cube defines the amount of the secondary award. Speakers output blender sounds to add excitement and realism to the video embodiment. In a mechanical embodiment, a physical blender contains lightweight indicators in the general shape of ice cubes. An air supply tube in communication with the blender causes the indicators to circulate within the blender. A second tube creates a vacuum thereby causing one of the indicators to be captured by a lid protrusion. Other mechanical versions are disclosed as well. A system for evaluating and transmitting the value of the captured indicator to a machine processor is disclosed.

6 Claims, 21 Drawing Sheets

105

FIG. 4

| SYMBOLS ON PAY LINES | 1 COIN | 2 COINS | 3 COINS |
|---|---|---|---|
| | 2,500 COINS | 5,000 COINS | 7,500 COINS |
| | MULTIPLIER OR BONUS | MULTIPLIER OR BONUS | MULTIPLIER OR BONUS |
| | 500 COINS | 750 COINS | 1,00 COINS |
| | 150 COINS | 200 COINS | 250 COINS |
| | 125 COINS | 150 COINS | 175 COINS |
| | 100 COINS | 125 COINS | 150 COINS |
| | 70 COINS | 140 COINS | 210 COINS |
| | 50 COINS | 100 COINS | 150 COINS |
| | 45 COINS | 90 COINS | 135 COINS |
| | 40 COINS | 80 COINS | 120 COINS |
| | 30 COINS | 60 COINS | 90 COINS |
| | 20 COINS | 40 COINS | 60 COINS |
| | 15 COINS | 30 COINS | 45 COINS |
| | 10 COINS | 20 COINS | 30 COINS |
| | 5 COINS | 10 COINS | 15 COINS |

125

115

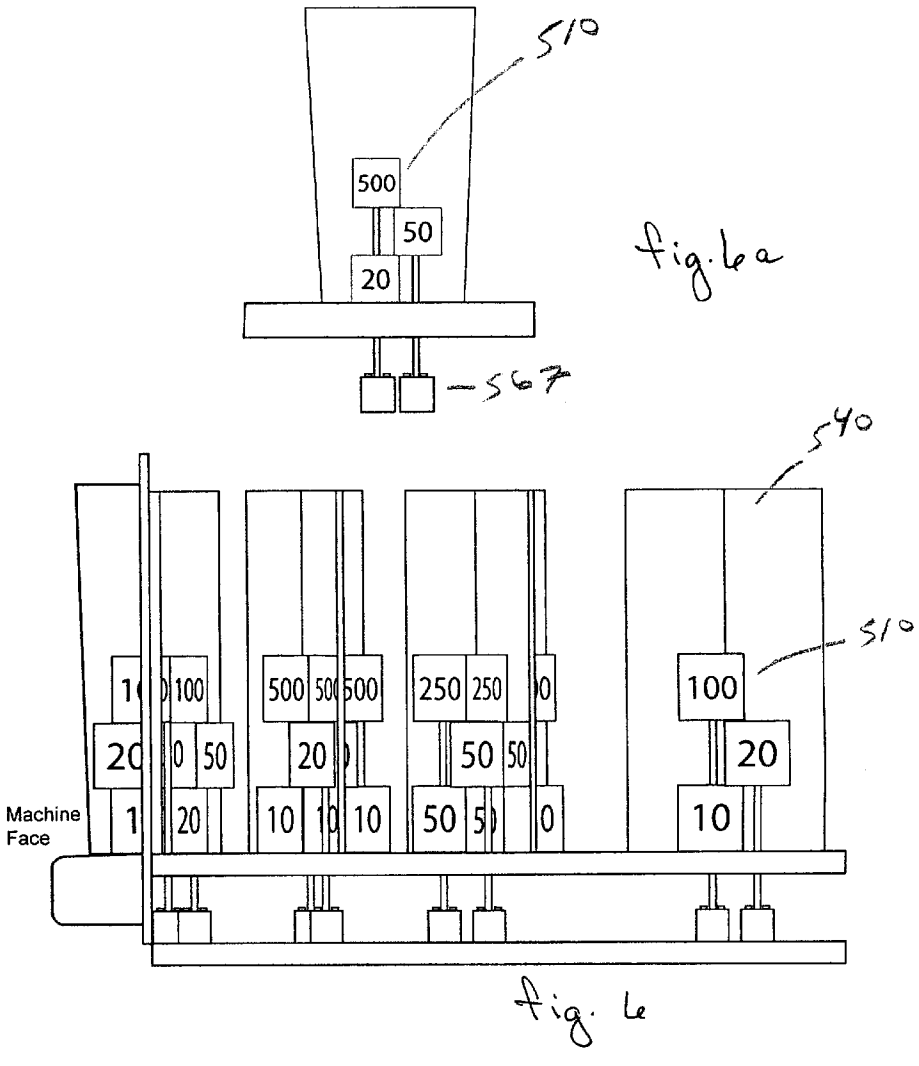
510
500
50
20
567
fig. 6a
540
510
100
20
10
250
250
50
50
50
50
500
500
500
20
10
10
10
100
50
0
20
Machine Face
fig. 6
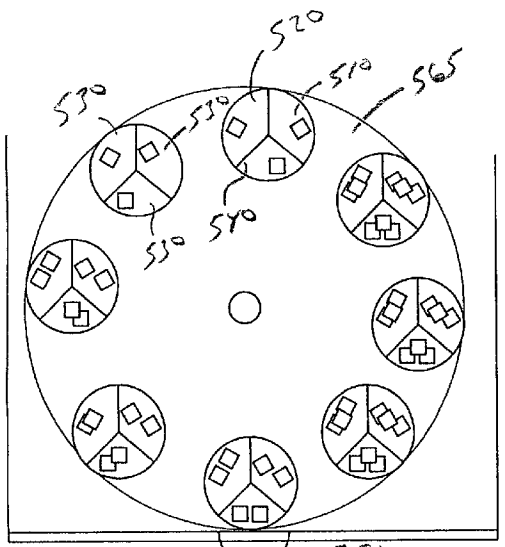
555
525
520
550
530
525
551
fig. 5

820
850
830
860
850-1 glass
20
865
5
6
7

885
890
870
880
900
905
910
20
50
10

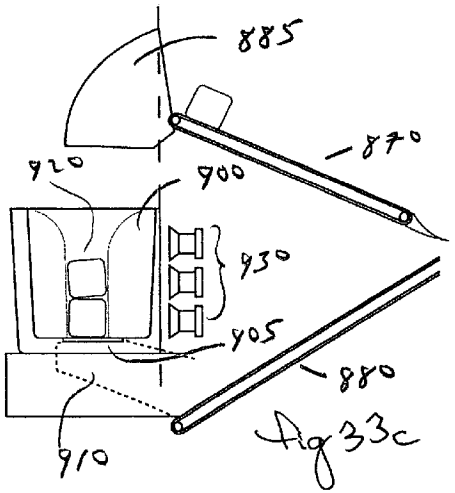
Fig 33a
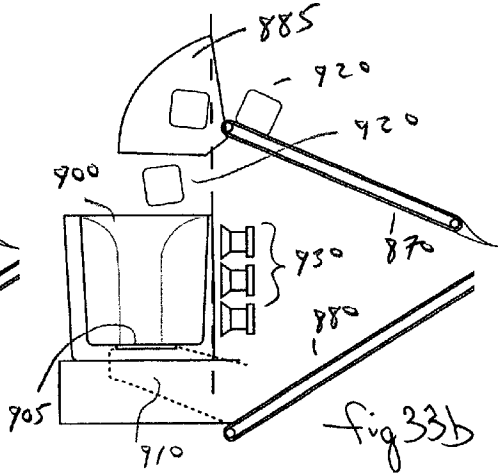
Fig 33b
Fig 33c
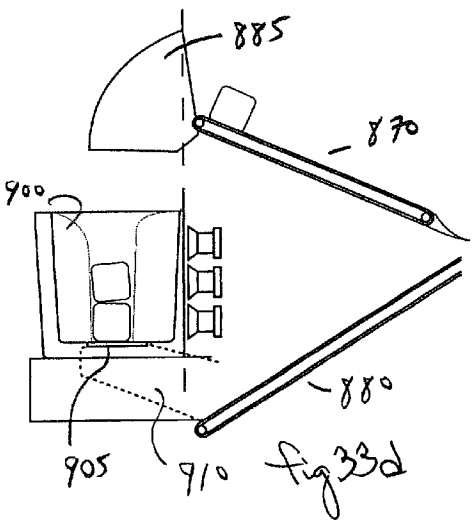
Fig 33d
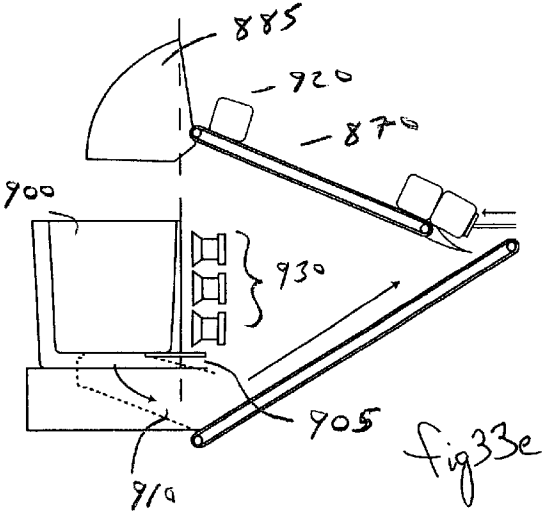
Fig 33e

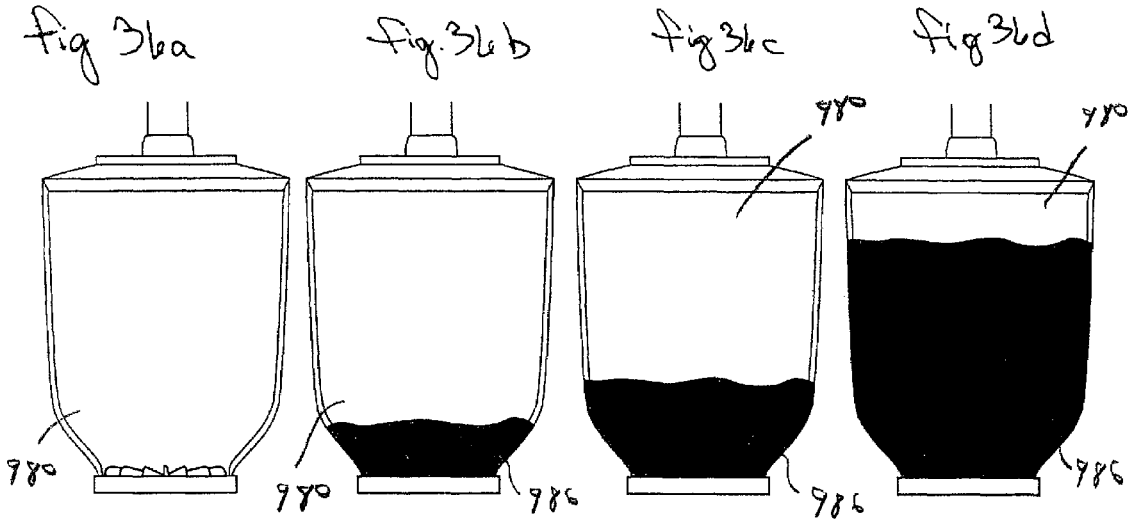
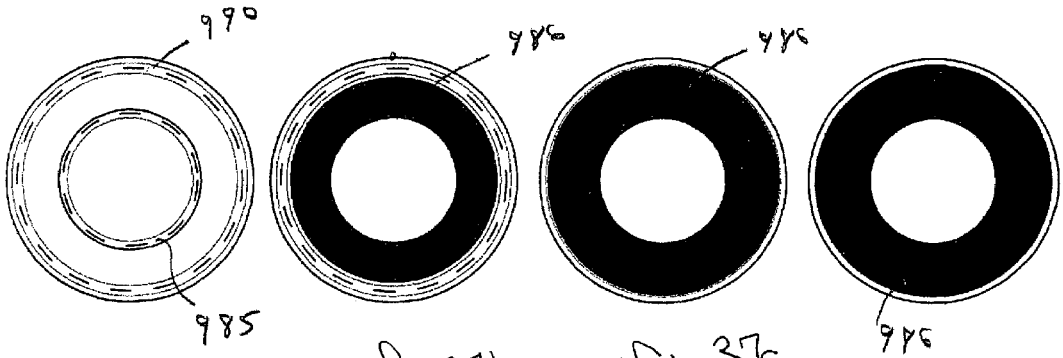
fig.37a fig37b fig.37c fig37d

ELECTRONIC GAMING MACHINE

CROSS-REFERENCE TO RELATED APPLICATIONS

This application is a continuation-in-part of application Ser. No. 10/603,499 filed Jun. 24, 2003 now abandoned.

FIELD OF INVENTION

The embodiments of the present invention relate generally to an electronically implemented gaming machine. More particularly, a slot machine incorporates a primary game and a secondary or bonus game.

BACKGROUND

Gaming machines are increasingly responsible for the bulk of revenues generated by casinos and other gaming establishments. Over time, electronic gaming machines, including slot machines, have systematically replaced table games as the most popular form of gaming in casinos. As a result, casino operators have a continuous desire for new games facilitated by electronic gaming machines.

One recently developed successful feature of slot machines is the secondary or bonus game. Secondary games are in electrical communication with a slot machine primary game and is actuated upon certain pre-established primary game outcomes. The primary game outcome is conventionally determined by a series of reels of the slot machine. The reels may be either mechanical or simulated in a video format. The reels incorporate gaming indicia which, along with one or more paylines, define the primary game outcomes.

One example of a popular slot machine incorporating a primary and secondary game is the popular Wheel of Fortune® slot machine. The Wheel of Fortune® slot machine includes a primary game comprising mechanical reels and a secondary game facilitated by a rotatable wheel analogous to the "wheel" associated with the game show of the same name. The secondary game is activated in response to a specific pre-established primary game outcome. In practice the specific primary game outcome occurs when the third reel payline of the primary game intersects a "spin the wheel" indicia. In fact, only the third reel includes a "spin the wheel" indicia. After the "spin the wheel" indicia appears, the player depresses a "spin the wheel" button causing the mechanical secondary wheel to spin thereby resulting in random secondary award.

Secondary games have become very popular because players enjoy the excitement and the extra opportunity to win an additional award. Moreover, the secondary games are conventionally programmed to result in a winning outcome on each activation. Thus, secondary games based on new and exciting themes are in constant demand.

Accordingly, the embodiments of the present invention are facilitated by an electronic gaming machine incorporating a primary game and a secondary game. The secondary game can be implemented in either a mechanical or video form.

SUMMARY

The embodiments of the present invention incorporate a secondary game having a mechanical blender apparatus or a video depiction thereof. While the blender is preferred, it can also be replaced or associated with a drink shaker, beer mug or other bar related item. The blender apparatus or video blender holds ice cubes which display values or other symbols related to an actual secondary award amount or a multiplier award. Upon activation of the secondary game, the blender is actuated thereby causing the ice cubes to agitate within the blender. Within a pre-established time period, one or more of the ice cubes are randomly captured and isolated for determining the amount of the secondary award.

In a mechanical format, the blender apparatus is generally in the form of a conventional blender albeit larger to hold a significant number of simulated ice cubes and to attract players to the slot machines incorporating the same. Upon a pre-established primary game outcome (e.g., a primary game payline intersects an ice cube gaming indicia on the third reel) the blender becomes active. The blender can be automatically actuated upon the pre-established primary game outcome or the gaming machine may incorporate a means for the player to cause the blender to actuate.

In a first embodiment, the simulated ice cubes are formed of a lightweight transparent material to resemble the appearance of real ice cubes. An air source in communication with the blender agitates the simulated ice cubes within the blender. A transparent housing extending vertically from a blender top captures one or more agitating simulated ice cubes.

To increase the excitement level of the mechanical blender, a speaker incorporated within the gaming machine may be activated to output a sound recording of a blender motor and blender blades acting upon ice cubes.

In another embodiment, a video display in communication with the primary game displays a simulated blender and simulated ice cubes having numerals or symbols depicted thereon. As described below, the video embodiment provides much more versatility than the mechanical embodiment as the video display can show any prerecorded material, including animation, desired. However, the ice cubes and corresponding values or symbols depicted thereon effectuate the same objective as the mechanical embodiment—that is determining a secondary award.

BRIEF DESCRIPTION OF THE DRAWINGS

FIG. 4 shows a proposed pay table.

FIG. 5 shows an alternative mechanical embodiment of the present invention;

FIG. 6 shows an alternative mechanical embodiment of the present invention;

FIG. 6*a* shows an alternative mechanical embodiment of the present invention;

FIGS. 28*a-e* and 29 show an alternative mechanical embodiment of the present invention;

FIGS. 33*a-e* show an alternative mechanical embodiment of the present invention;

FIGS. 36*a-d* and 37*a-d* show an alternative mechanical embodiment of the present invention;

DETAILED DESCRIPTION

The operation of electronic gaming machines, more particularly slot machines, is well-known in the industry so that the minute details are not set forth herein. In general terms, a slot machine is controlled by a processor including, or in communication with, a random number generator. The random number generator generates the machine outcomes. Gaming indicia on mechanical or video reels and one or more pay lines determine random game outcomes.

Figure 1:
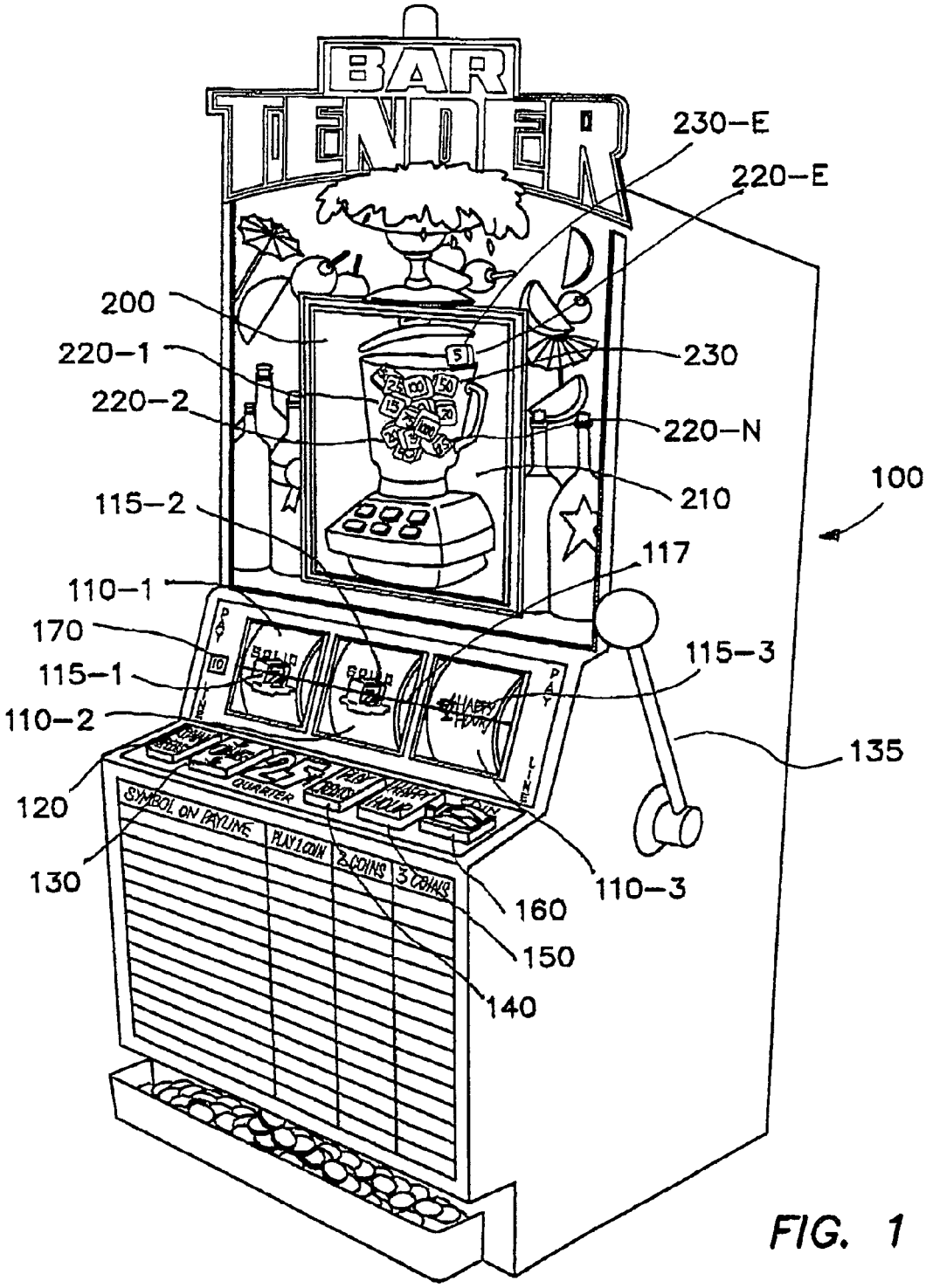
FIG. 1 shows a video embodiment of the present invention.

Reference is now made to the figures wherein like parts are referred to by like numerals throughout. FIG. 1 illustrates a perspective view of an electronic gaming machine, generally denoted by reference numeral 100, for facilitating the embodiments of the present invention. The machine incorporates a primary reel game and a secondary video game. As shown, three mechanical reels 110-1 through 110-3 enable the primary game. While only three mechanical reels 110-1 through 110-3 are shown, more or less than three reels may be used to enable the primary game. For example, two or five reels may be used. In addition, the reels 110-1 through 110-3 may be provided in a video format rather than a mechanical format.

Figure 3:
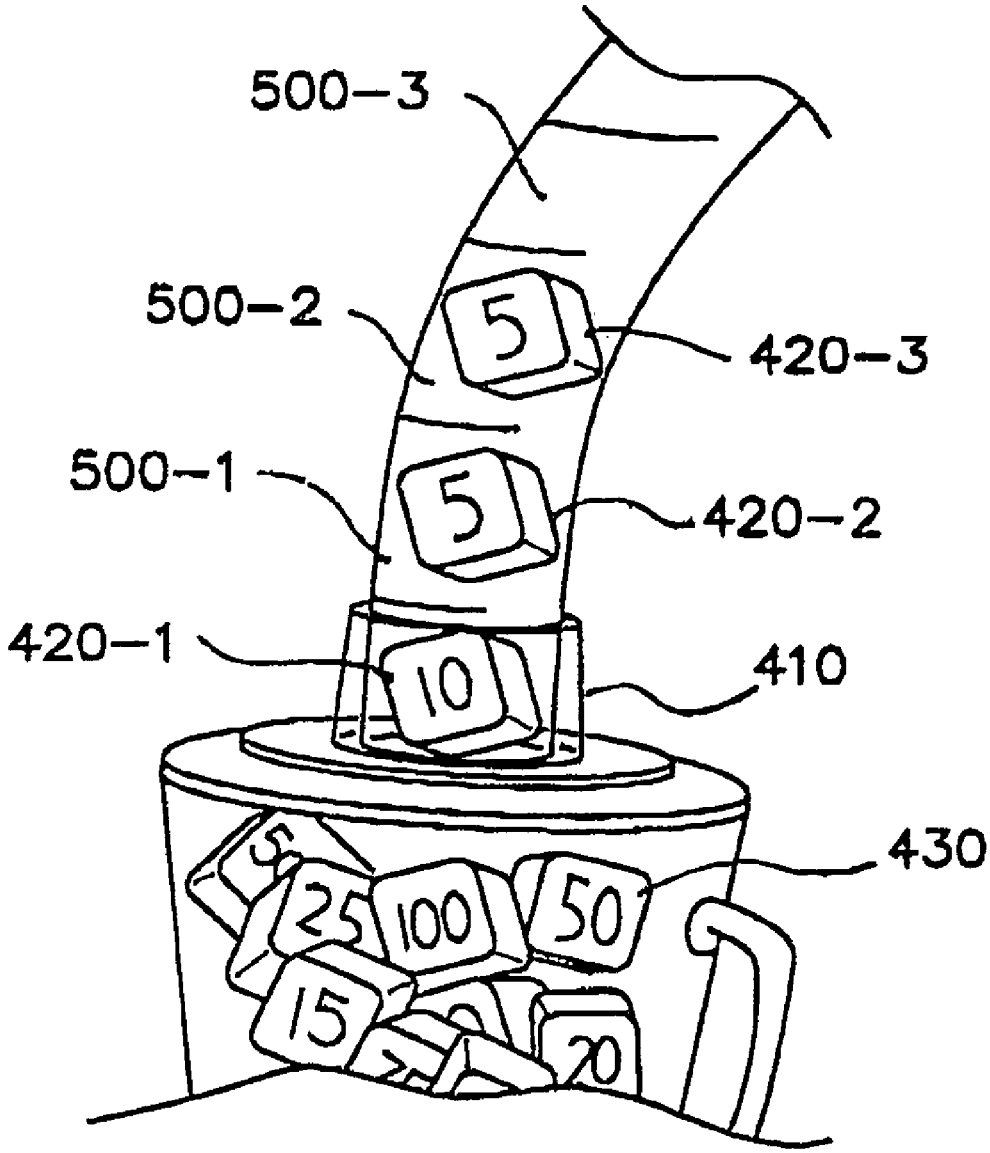
FIG. 3 shows a close-up view of a blender lid and communicating vacuum tube.

The three reels 110-1 through 110-3 include gaming indicia 115-1 through 115-3 thereon. Upon activation, the three reels 110-1 through 110-3 spin until each reel from left to right are stopped by the machine processor at pre-established positions. A pay line 117 defines winning outcomes. While only a single pay line 117 is shown, multiple pay lines, including diagonal pay lines, may be incorporated. Based on the alignment of the gaming indicia 115-1 through 115-3 along the pay line 117 the processor determines a player's winnings, if any. A proposed pay table illustrating gaming indicia and associated pay outs is shown in FIG. 3. It is noted that the gaming indicia are only exemplary and may take any designs desired. Moreover, the primary game does not have to be a slot machine but may be any type of gaming machine, including video poker, video keno, etc.

The machine 100 includes several player buttons which act as interfaces between the player and the machine processor. Player buttons include a spin button 120, a change button 130, a play one credit button 140, a play maximum credits button 150 and a secondary actuation button 160. Instead of the spin button 120, a player may activate the machine 100 by means of an arm 125 (i.e. handle). Each of the player buttons and the arm 125 are in electrical communication with the processor such the player may control the operations of the machine 100. A player interface may also be implemented through a touchscreen system.

The machine 100 also incorporates a coin acceptor 170, a credit display 180 and a bill validator 190. Players may insert coins or bills depending on the specific player's preference. The credit display 180 allows players to play on credit such that any gaming winnings or loses are immediately depicted in the display 180. Once a playing session ends, the player may cash out for any monies owed. While not shown, the machine 100 may also incorporate a ticket dispenser for printing tickets for redemption at a cashier window. Such cashless systems are becoming increasingly popular in gaming jurisdictions.

In one embodiment, a secondary game comprises a video display 200 and is activated by certain pre-established primary game outcomes. For example, if a pre-established gaming indicia of the third reel 110-3 aligns with the pay line 117, the secondary game may be activated. Ideally, the secondary game is actuated by the player depressing the secondary game button 160. Players will appreciate the ability to actuate the secondary game. In addition, players often believe in superstitions that can be exercised by deciding the exact time or method of depressing the secondary game button 160. Alternatively, the secondary game may be actuated automatically by the processor in response to a pre-established primary game outcome.

Participation in the secondary game may also be a function of the number of coins played. For example, the machine 100 may allow players to play one to three coins. Therefore, to participate in a secondary game the player must play three coins. Should the player play only one to two coins and receive the preestablished primary game outcome, the player is only eligible for the primary game award. Such an arrangement encourages the play of maximum number of coins.

The secondary game comprises a video depiction of a blender 210 containing ice cubes 220-1 through 220-N. Each ice cube 220-1 through 220-N has a value 230 or symbol depicted thereon. The value 230 or symbol is used to identify a bonus award or a multiplier. Once actuated, the video display 200 shows an animated bartender behind a bar ready to serve a customer. The video display 200 then shows a customer walk to the bar. The customer is intended to represent the player. The bartender then uses an ice scoop to place ice cubes 220-1 through 220-N into the blender 210. Once the ice cubes 220-1 through 220-N are placed into the blender 210, the bartender places a lid 240 on the blender 210 and presses a button to start the blender 210. The video display 200 then pans in to show a close-up view of the blender 210 and the ice cubes 220-1 through 220-N being agitated therein. The agitation of the ice cubes 220-1 through 220-N creates a high level of excitement as the player observes the different numbers 230 being randomly agitated and anticipates the ultimate award. As the blender 210 speed increases, the ice cubes 220-1 through 220-N rise to the top of the blender 210. At some point in time, the lid 240 is shown to partially dislodge permitting one or more of the ice cubes 220-1 through 220-N to be ejected from the blender 210. The ejected ice cube 220-E is shown sliding down the length of the bar. The value 230-E or symbol depicted on ejected ice cube 220-E defines the bonus award or multiplier.

If the ice cube 220-E acts a bonus award, the value 230-E depicted thereon corresponds to the secondary award. The bonus award is then summed to itself for each coin played (i.e., multiplied by the number of coins played). The secondary award is then applied to the credit display 180 or paid out in coins. Alternatively, the ejected ice cube 220-E may include a value 240-E in combination with an "×" symbol. The "×" symbol represents the multiplication symbol. Thus, an ice cube depicting "3×" signifies that the primary game award is multiplied by three.

In one embodiment, the secondary game is activated by a single pre-established gaming indicia on the third reel 110-3. In this embodiment, the ice cube 220-E acts as a bonus award when the pre-established gaming indicia 115-3 of the third reel 110-3 aligns with the pay line 117 and the gaming indicia 115-1, 115-2 of the first and second reels 110-1, 110-2 do not match one another. If gaming indicia 115-1, 115-2 of the first and second reels 110-1, 110-2 do match one another and the pre-established gaming indicia 115-3 of the third reel 110-3 aligns with the pay line 117, the ice cube 220-E acts as a multiplier. The processor, based on the primary game outcome, will determine which ice cubes (e.g. bonus or multiplier) are shown on the video display.

In another embodiment, a single identical pre-established gaming indicia is on each reel 110-1 through 110-3. A bonus award is paid when the identical pre-established gaming indicia of the first and second reels 110-1, 110-2 align with pay line 117. If only the pre-established gaming indicia of the third reel 110-3 aligns with the pay line 117, the primary game award is multiplied. If the pre-established gaming indicia of the first and second reels 110-1, 110-2 align with the pay line 117, two ice cubes are ejected from the blender and their sum is added together to derive the bonus award. If the pre-established gaming indicia of the first reel 110-1 or the second reel 110-2 and the third reel 110-3 align with the pay line 117, two ice cubes are ejected from the blender with the first acting as a bonus award and the second being a multiplier. Therefore, the bonus award is multiplied by the multiplier to derive the total bonus award. Should the pre-established gaming indicia of the first reel 110-1, the second reel 110-2 and the third reel 110-3 align with the pay line 117, three ice cubes are ejected. The first and second ice cubes are summed to obtain the bonus award which is then multiplied by the value of the third ice cube to derive the total bonus award. In other words, the first two reels 110-1 and 110-2 act as bonus reels and the third reel 110-3 acts as a multiplier reel.

To increase the excitement level of the embodiments of the present invention, the gaming machine 100 further incorporates one or more speakers for outputting certain audible noises corresponding to the activation of an actual mechanical blender. By way of example, when the bartender uses the ice scoop to place ice cubes into the blender 210, the one or more speakers will output corresponding sounds. Similarly, the speakers may output blender 210 sounds when appropriate.

Figure 2:
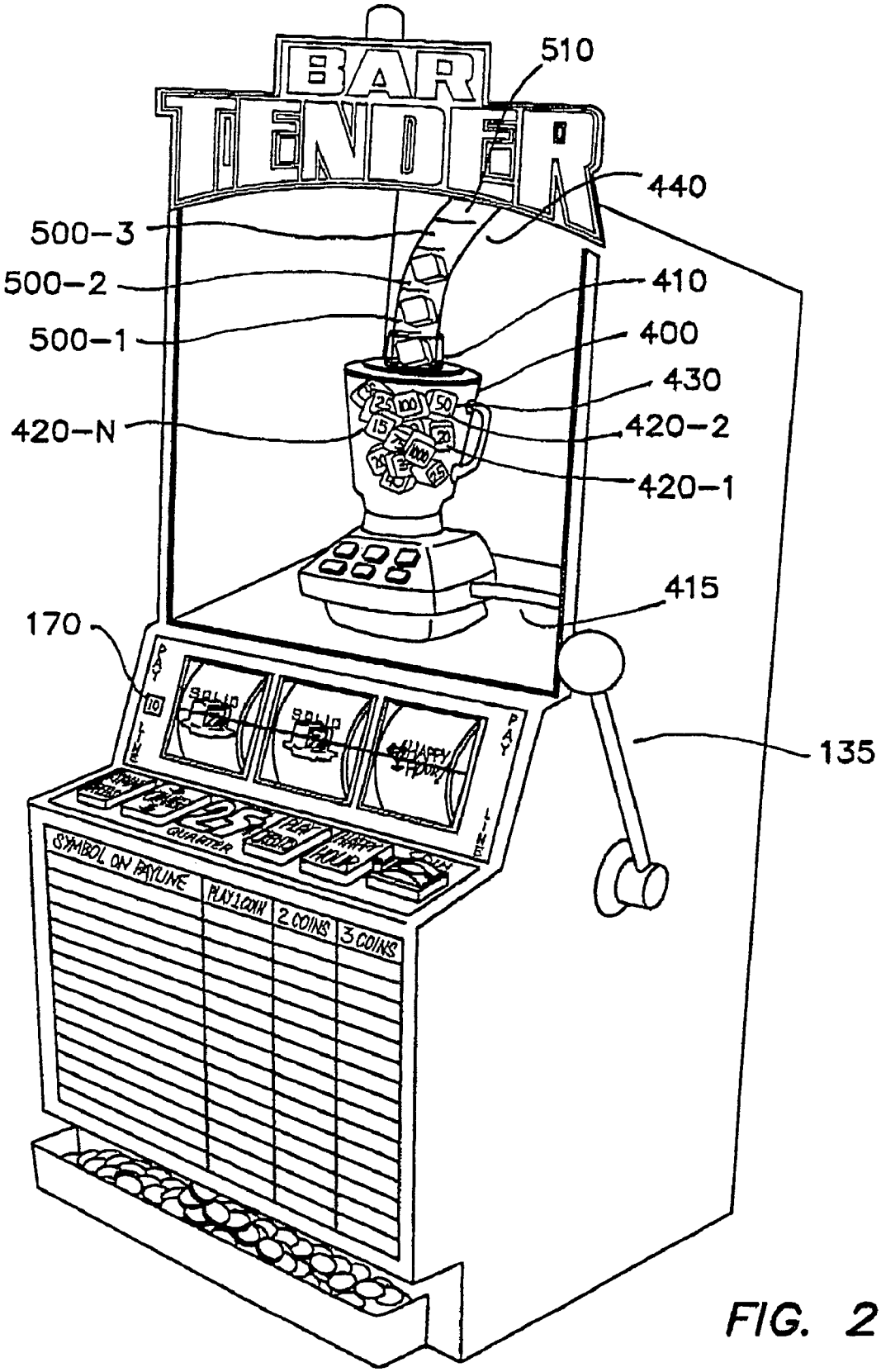
FIG. 2 shows a mechanical embodiment of the present invention.

Now referring to FIG. 2, the secondary game is implemented in a physical embodiment. A transparent blender 400, lid 410 and award indicators 420-1 through 420-N comprise the physical embodiment of the secondary game. The blender 400 communicates with the machine processor. In addition, the blender 400 communicates with an air supply via tube 415. Lightweight, generally square, bonus or multiplier indicators 420-1 through 420-N are contained within the blender 400. The indicators 420-1 through 420-N have the general appearance of ice cubes. As with the video embodiment, the indicators 420-1 through 420-N depict certain values 430 or symbols corresponding to a bonus award or multiplier.

Figure 10:
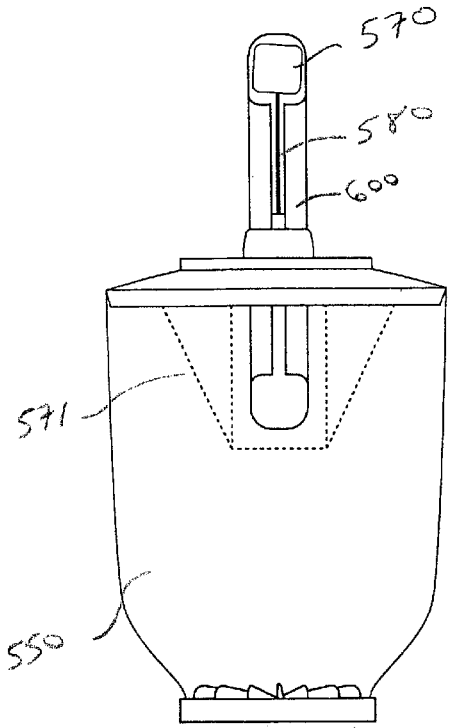
FIGS. 10-11 show an alternative mechanical embodiment of the present invention.

In response to pre-established primary game outcomes, the indicators 420-1 through 420-N are agitated by the air supply such that the indicators 420-1 through 420-N randomly circulate within the blender 400. At the correct moment, a second tube 440 in communication with the lid 410 creates a vacuum within a lid protrusion 450. The vacuum causes the lid 410 to capture one or more indicators 420-C. The indicators 420-C depicts the bonus award or multiplier. As shown in FIG. 10 lightweight cubes 425 may be agitated by motor 435 driven rubber blades 445. The second tube 440 may then capture one or more of the cubes 425.

In the mechanical embodiment, the processor must be able to determine the value or symbol depicted on the captured indicator 420-C. In a first embodiment, each indicator 420 includes a readable bar code that is scanned as the indicator is captured by the lid 410. The scanned bar code includes the value 430 or symbol depicted on the captured indicator 420 so that the value 430 or symbol is transmitted to the processor. In an alternative embodiment, a video camera directed at the lid protrusion 450 may capture and recognize the value or symbol of the indicator 420-C and transmit the same to the processor. Alternatively, electrical contacts incorporated on the indicators 420-1 through 420-N mate with corresponding electrical contacts on an upper surface of the lid protrusion 450. The value or symbol of the indicator 420-C is then transmitted via the electrical contacts to the processor. Any means for determining and transmitting the value or symbol of the indicators 420-C can be used.

Figures 7, 8, 9:
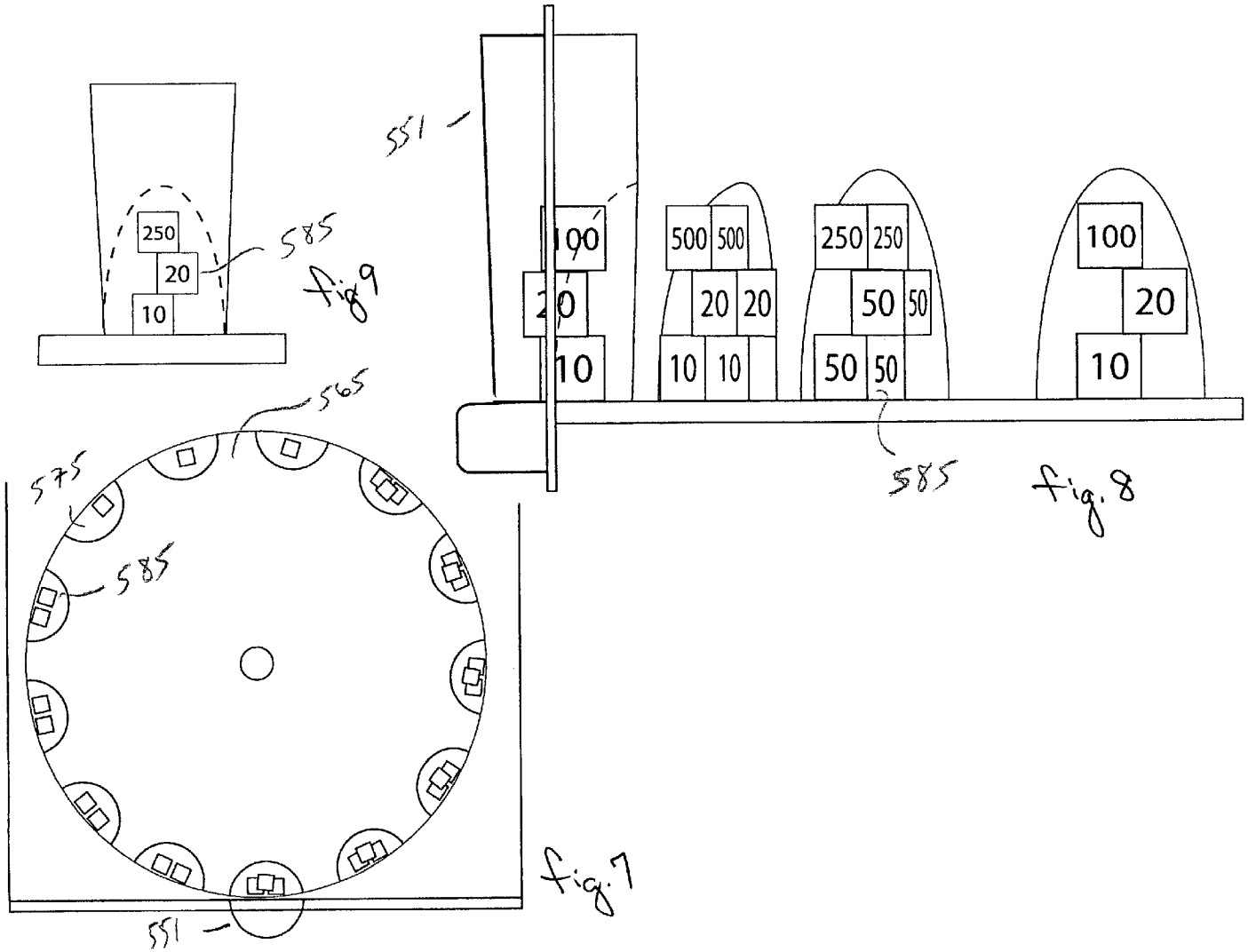
FIGS. 7-9 show an alternative mechanical embodiment of the present invention.

An alternative mechanical embodiment is shown in FIGS. 5-6*a* and comprises a plurality of cubes 510 supported on a rotatable segmented platform 520. The segments 530 are defined by walls 540 and are arranged such that each segment 530 may be positioned within the blender 550 (or glass 551) in a viewable manner. In this fashion, the cubes 510 and depicted numerals 560 are presented to the player. The numerals 560 are then used in combination to identify a player award. A rotatable support surface 565 positions the appropriate segmented platform 520 in the blender 550. A motor (not shown) drives each rotatable platform 520 and the rotatable support surface 565. Also, the cubes may be individually rotated via motors 567. As shown in the top view, a portion of the glass 551 extends outward from the gaming machine. FIGS. 7-9 shows a related embodiment wherein the support surface 565 supports a plurality of platforms 575 supporting one or more cubes 585.

Figure 11:
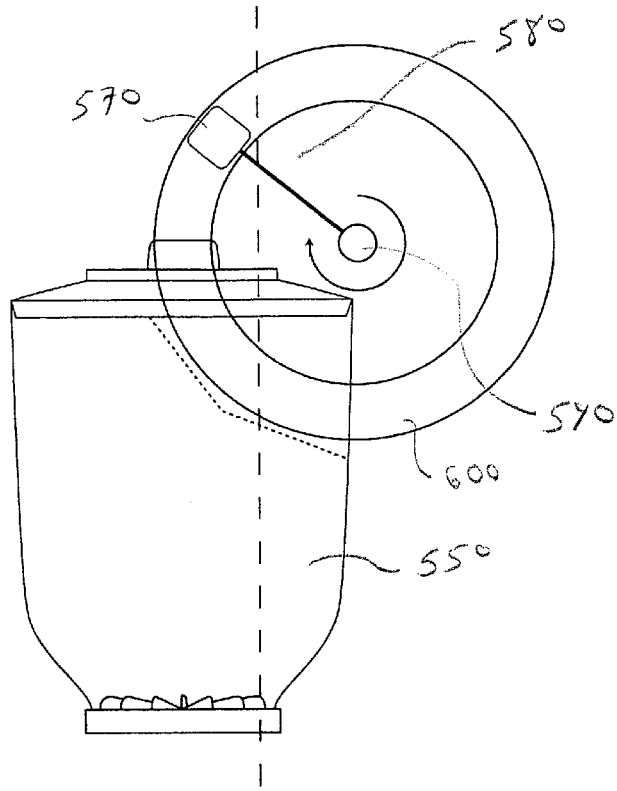
Figure 12:
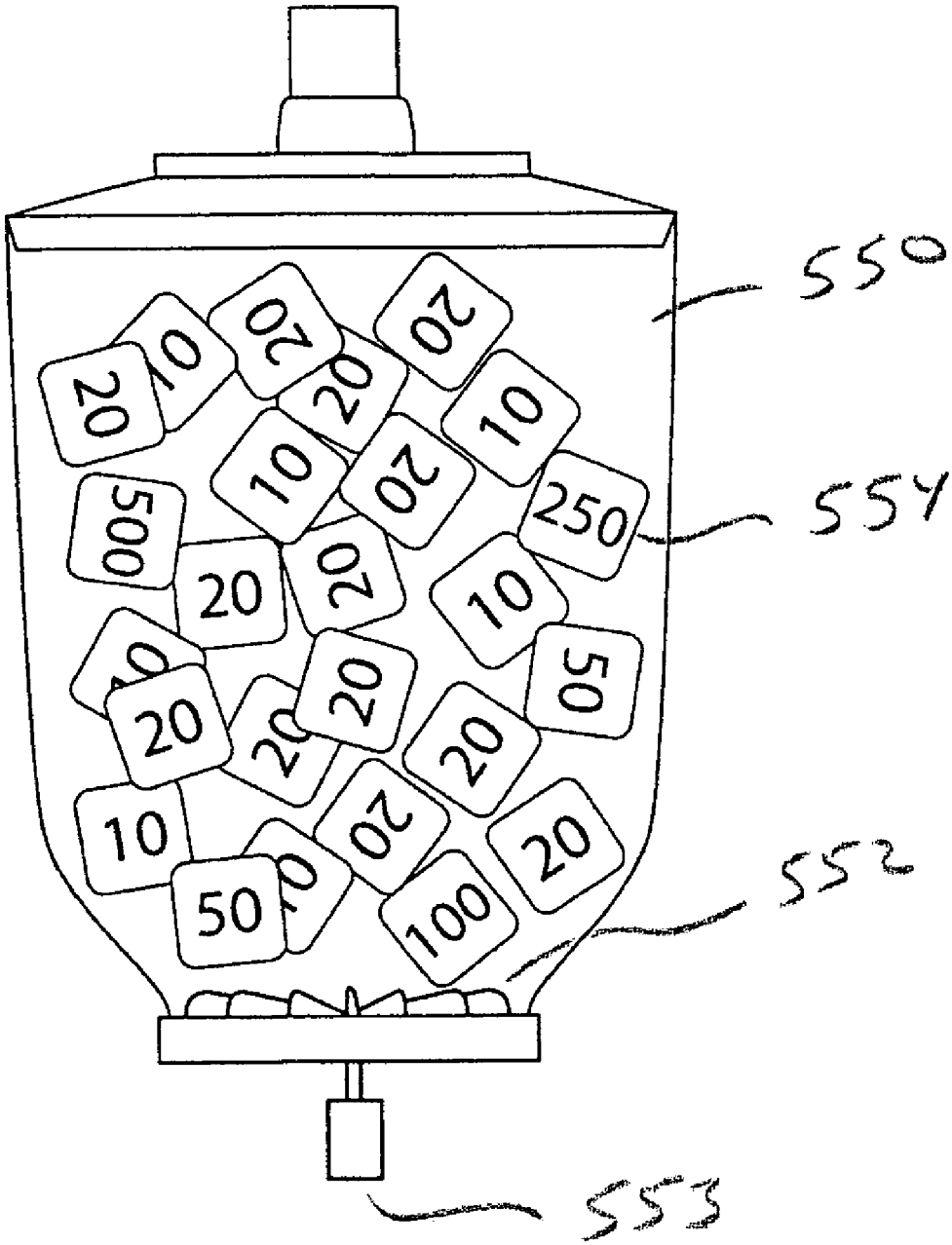
FIG. 12 shows a series of paddles for agitating contained cubes.

Another alternative mechanical embodiment is shown in FIGS. 10-11 and comprises a single cube 570 attached to a first end of a rod 580. A second end of the rod 580 is connected to rotatable member 590. A circular tube 600 contains the cube 570. In actuality, a panel 571 conceals the motion of the cube 570 and rod 580 while it rotates within the blender 550. Thus, the player only observes the cube 570 while it appears to shoot out the top of the blender 550. While not shown, in practice, the blender is filled with air and/or paddle agitated cubes such that the player believes the cube 570 has exited from within the blender and the agitated cubes. FIG. 12 shows the blender 550 having paddles 552 and a corresponding motor 553. The paddles 552 should be made of a material that does not harm the cubes 554.

Figure 13:
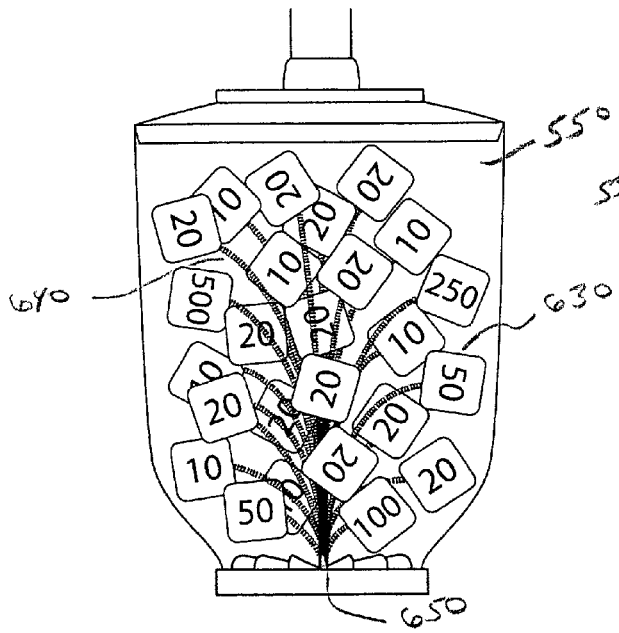
FIGS. 13-14 show an alternative mechanical embodiment of the present invention.
Figure 14:
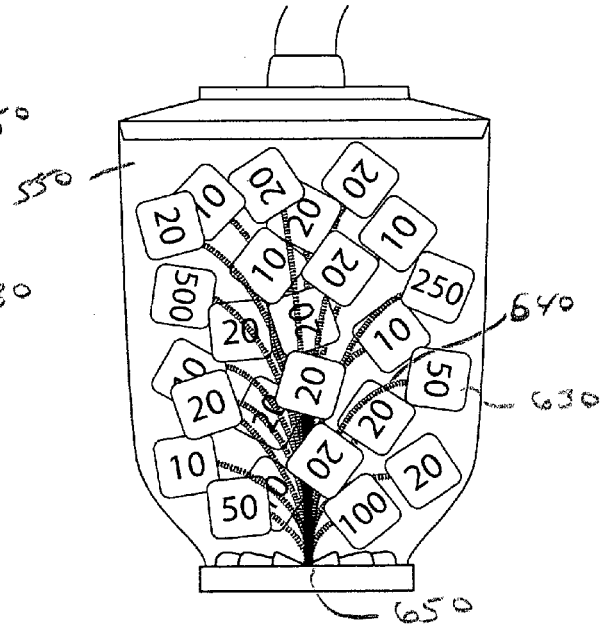
Figure 15:
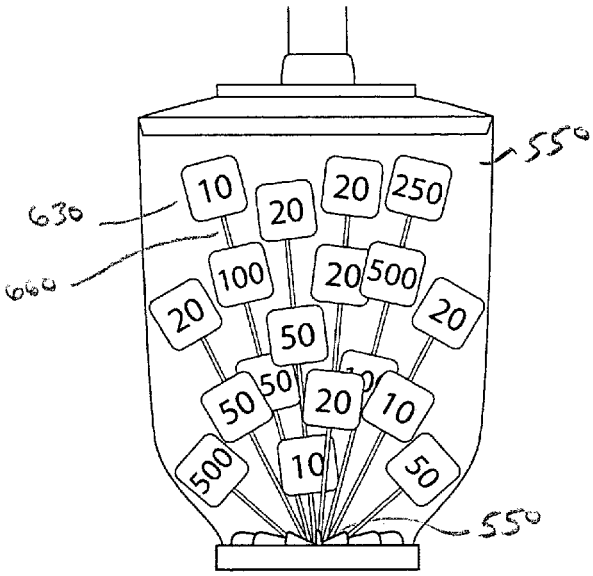
FIGS. 15-17 show an alternative mechanical embodiment of the present invention.
Figure 16:
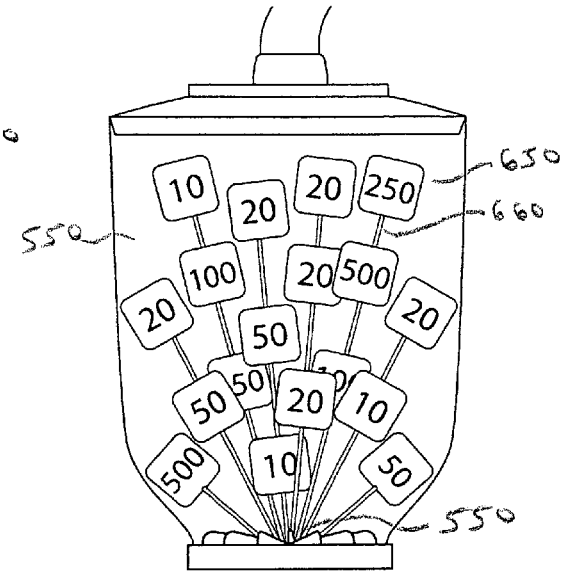
Figure 17:
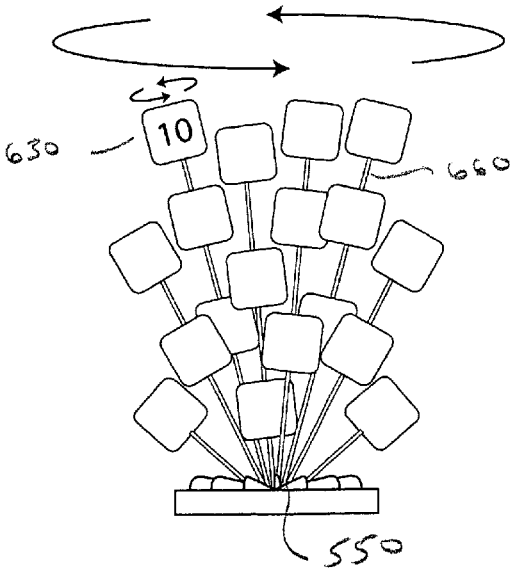

Another alternative mechanical embodiment is shown in FIGS. 13-14 and comprises a plurality of cubes 630 each connected to a first end of an elongated flexible spring 640. A second end of the springs 640 are commonly attached to a rotatable base member 650. In this manner, the plurality of cubes 630 may be rotated to give the appearance of agitation. The flexible springs 640 also permit the cubes 630 to subtly, but noticeably, change vertical position. Alternatively, as shown in FIGS. 15-17, the cubes 630 may each be connected to a first end of an elongated rigid rod 660. As with the springs 640, second ends of the rods 660 are commonly attached to the rotatable base member 650. Additionally, the use of rods 660 permits each cube 630 to be individually rotated as well.

Figure 19:
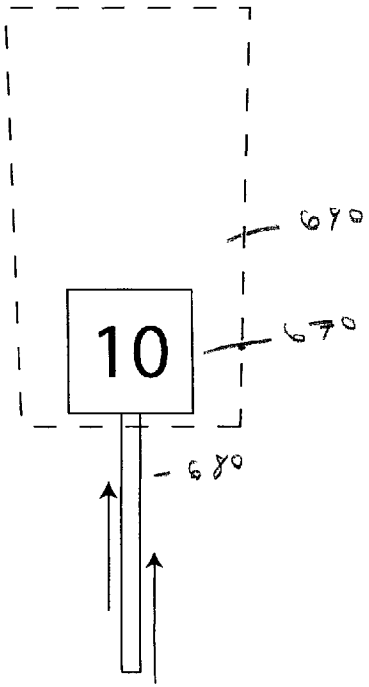
FIGS. 18-20 show an alternative mechanical embodiment of the present invention.
Figure 20:
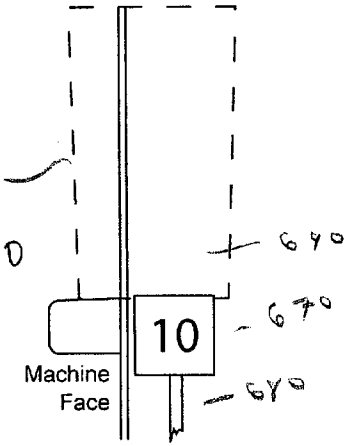
Figure 18:
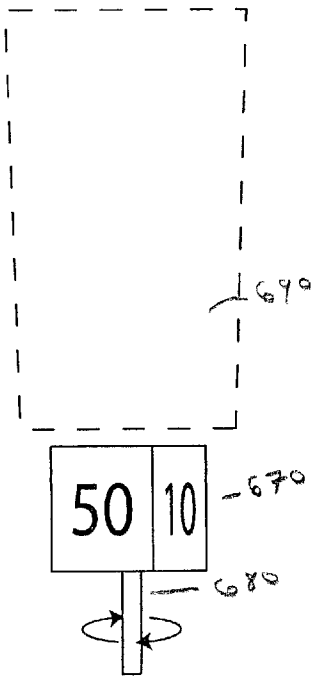
Figure 21:
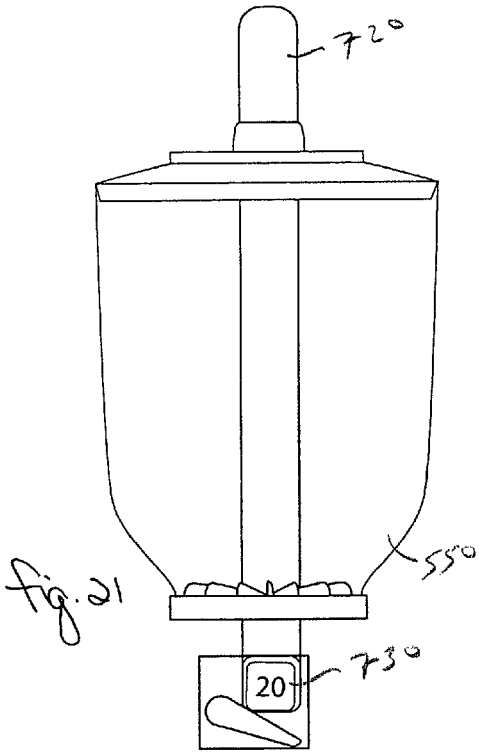
FIGS. 21-22 and 23*a-d* show an alternative mechanical embodiment of the present invention.
Figure 22:
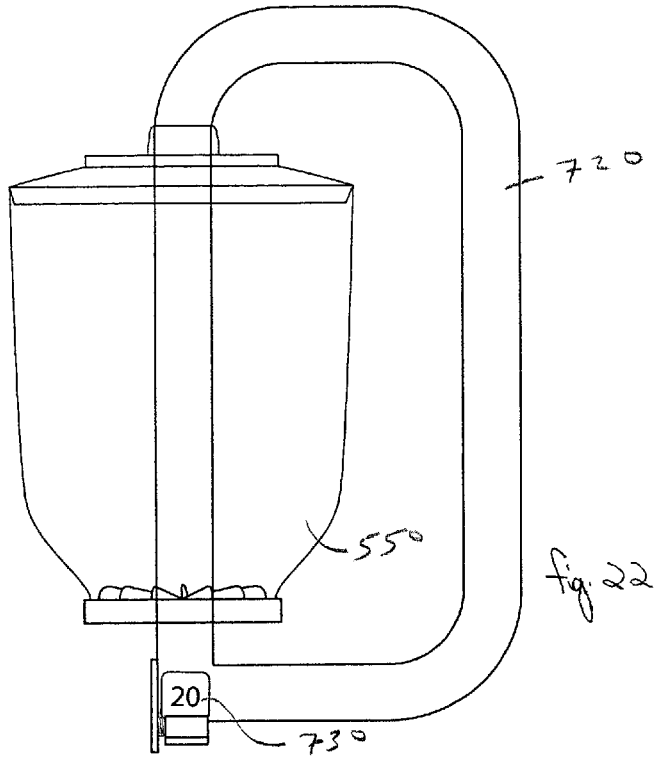
Figure 23A:
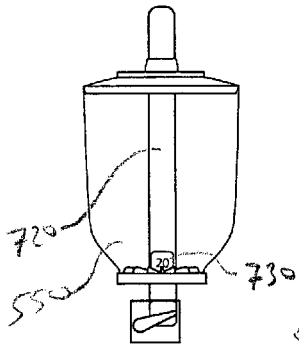
Figure 23B:
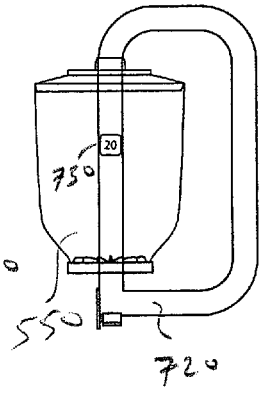
Figure 23C:
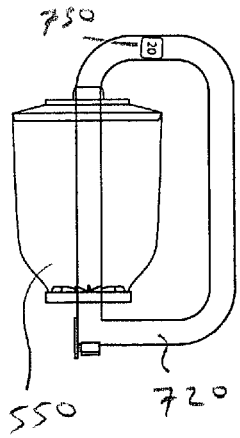
Figure 23D:
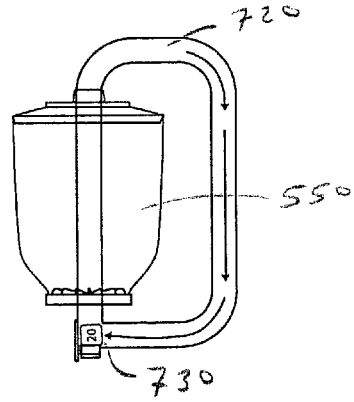
Figure 24:
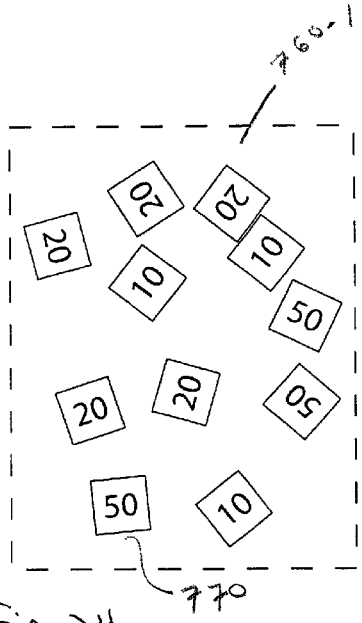
FIGS. 24-27 show an alternative mechanical embodiment of the present invention.
Figure 25:
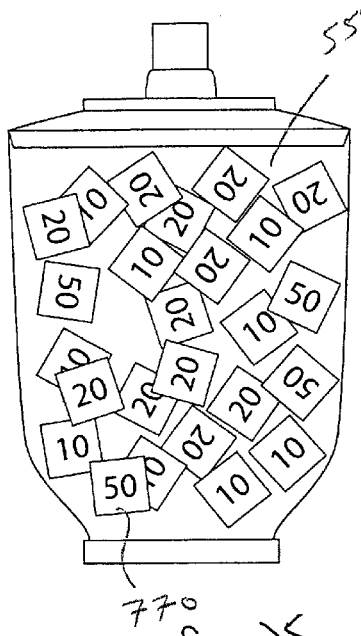
Figure 26:
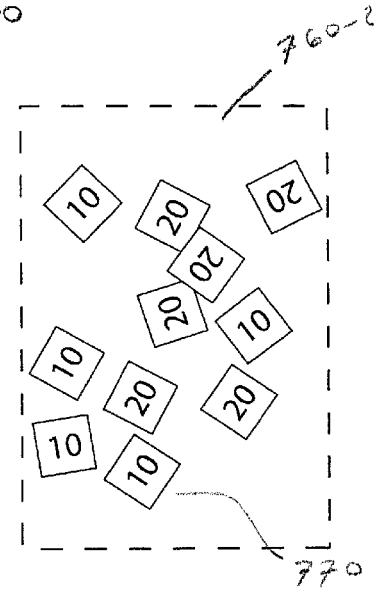
Figure 27:
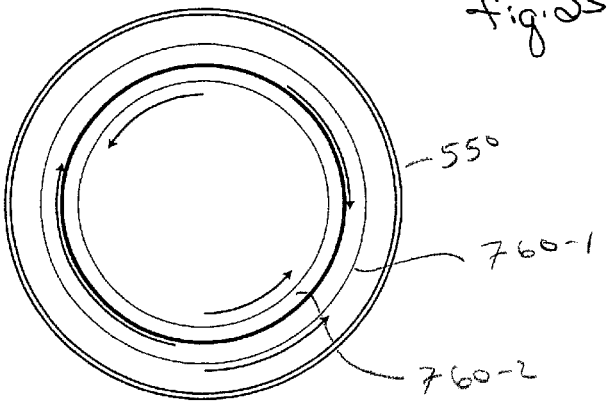
Figures 8A, 8B, 8C, 8D, 8E, 8F:
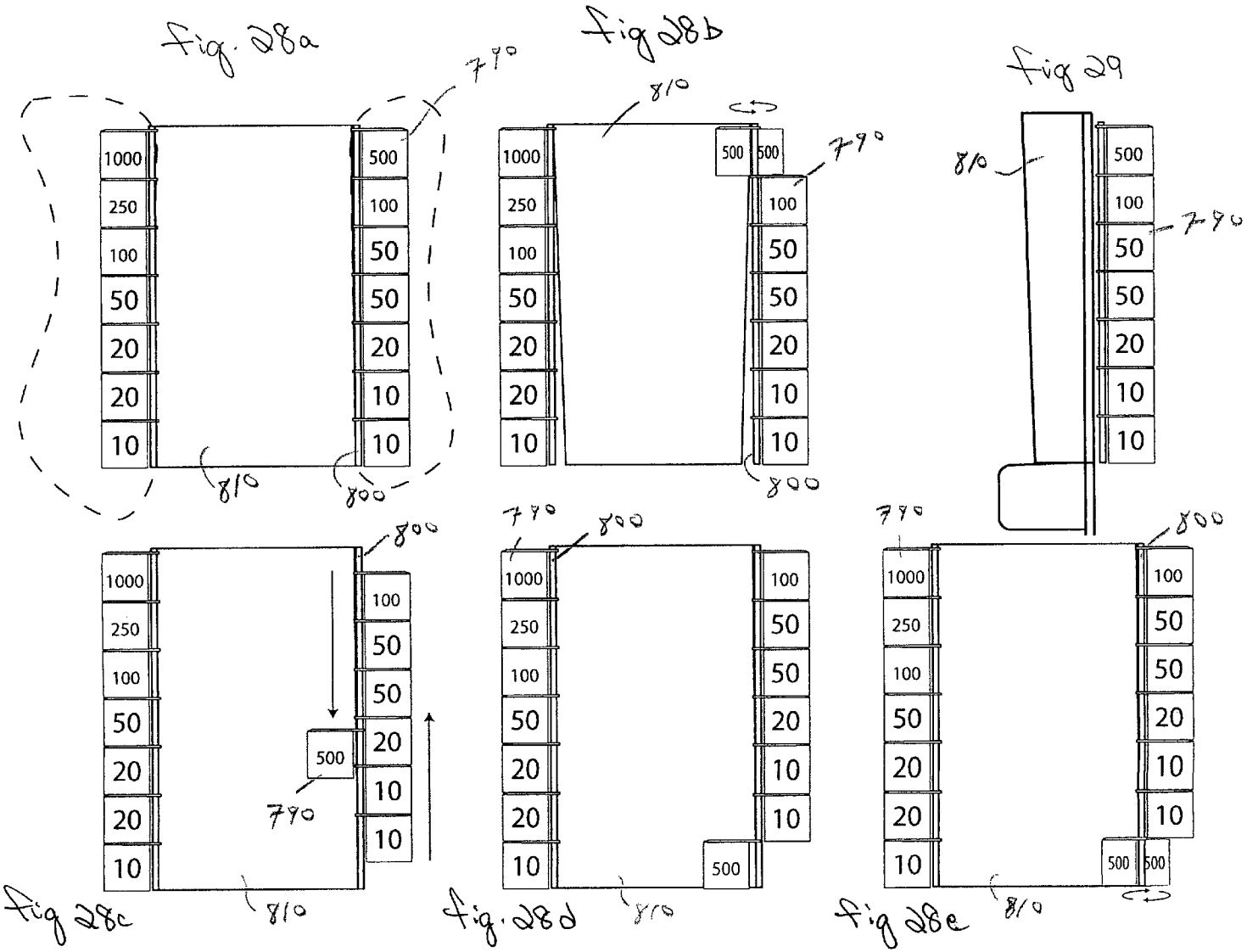
Figures 30A, 30B, 30C, 30D, 31A, 31B, 31C, 31D, 31E, 31F, 31G, 31H:
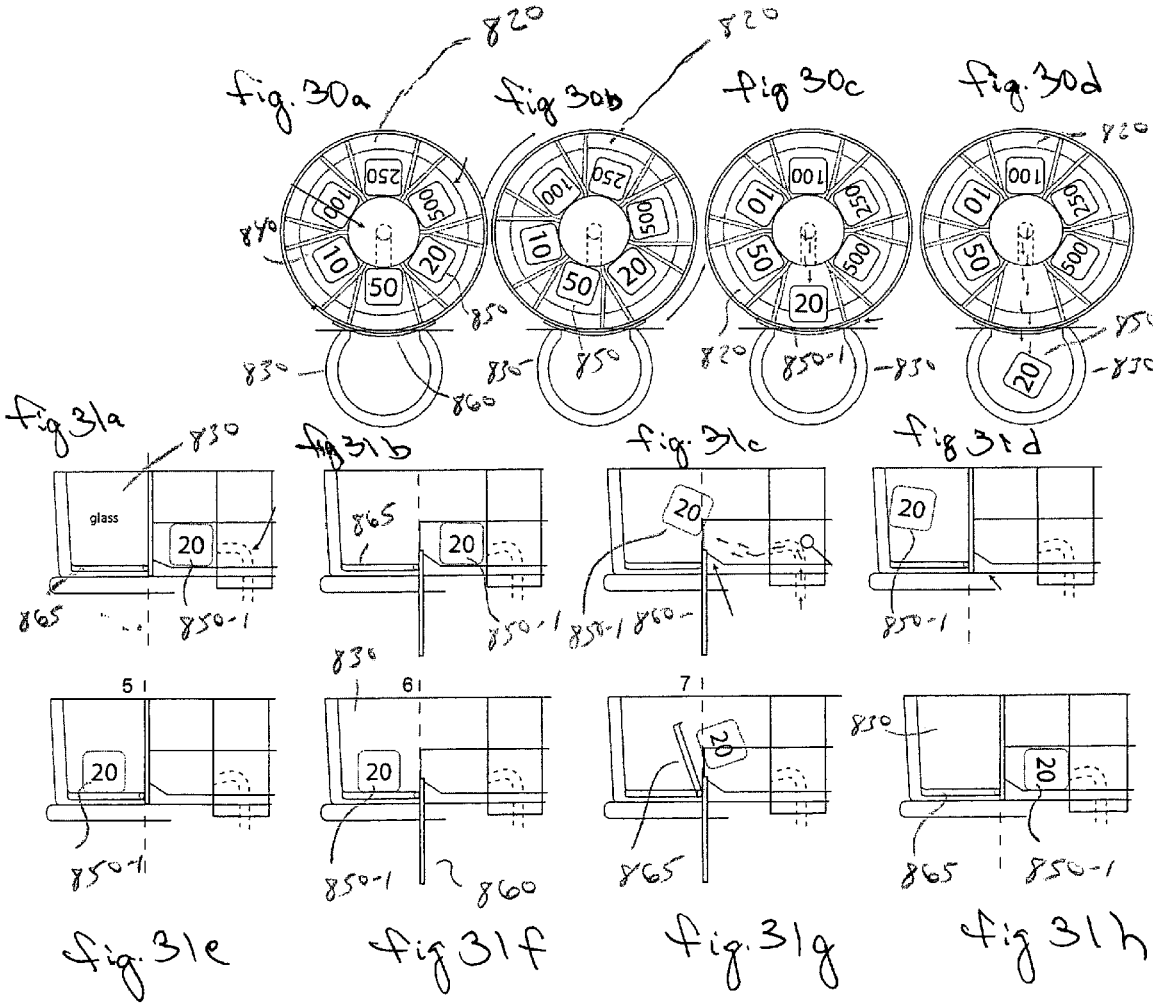
FIGS. 30*a-d* and 31*a-h* show an alternative mechanical embodiment of the present invention.
Figures 32A, 32B, 32C, 32D, 32E, 32F:
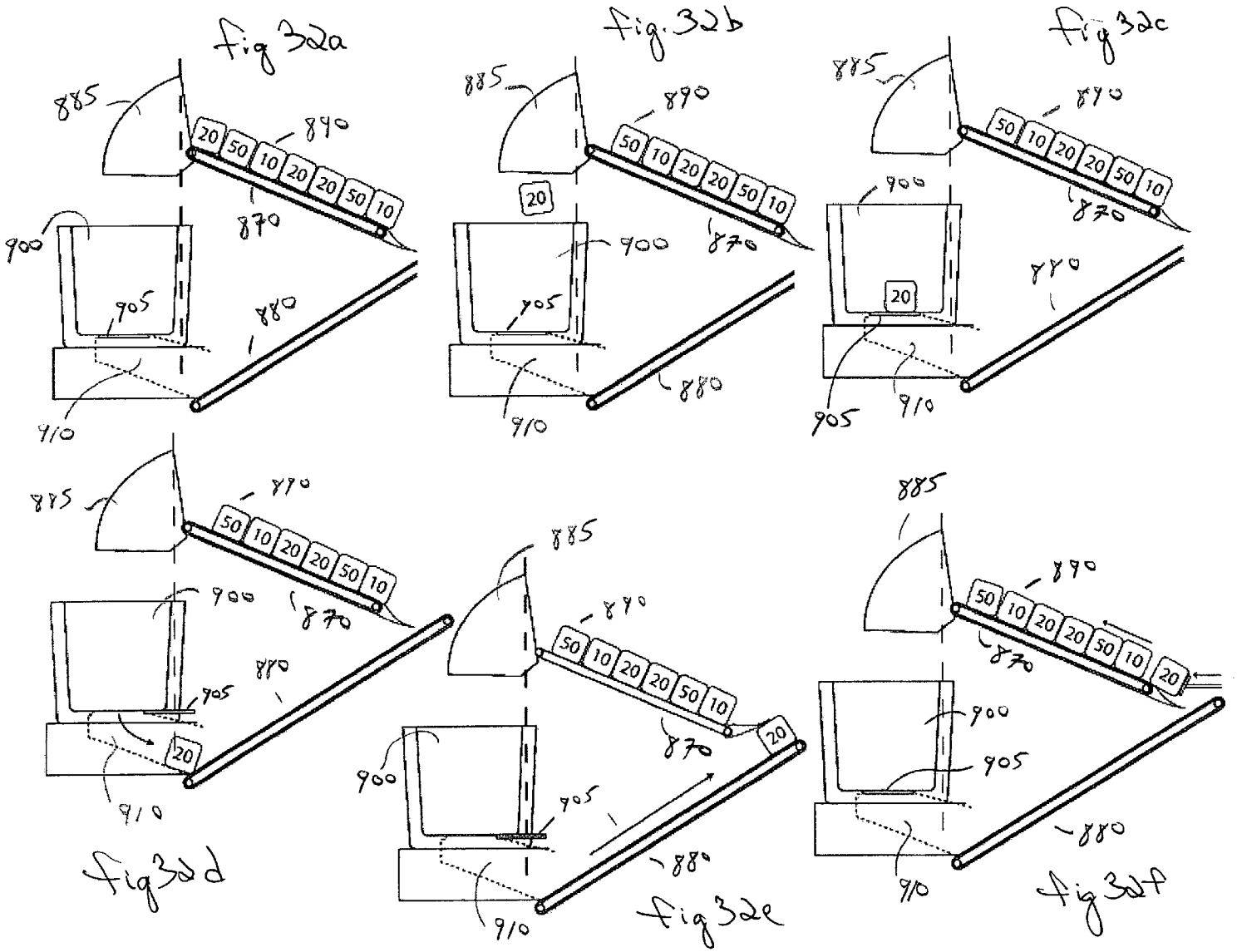
FIGS. 32*a-f* show an alternative mechanical embodiment of the present invention.

FIGS. 18-20 show a single cube mechanical embodiment comprising a single cube 670 attached to a rotatable rod 680 positioned below or behind a blender or glass 690. In this embodiment, each side 700 of the cube 670 depicts a different numeral 710 depicting a different award. Thus, when the cube 670 is inserted into the glass 690, the cube 670 rotates and stops on the pre-established numeral 710 depicting the award.

FIGS. 21-22 and 23*a-d* show another alternative mechanical embodiment comprising a tubular member 720 for containing and directing one or more cubes 730 into a viewable position within the blender 550. A spring-loaded flipper mechanism 750 or a stream of air acts to propel the one or more cubes 730 through the blender 550. The tubular member 720 then directs the cube 730 back to its original position. Again, in practice and in a manner akin to the embodiment shown in FIGS. 10-11, the blender 550 includes a plurality of cubes to conceal the tubular member 720.

FIGS. 24-27 show another alternative mechanical embodiment comprising multiple layers of film 760-1 and 760-2 having cubes 770 depicted thereon. The multiple films 760 are arranged with one inside the other to provide the appearance of a plurality of cubes 770 being agitated within the blender 780.

FIGS. 28*a-e* and 29 show another alternative mechanical embodiment comprising a plurality of cubes 790 are hinged to tracks 800 placed adjacent on opposite sides of a blender 810 or glass out of view from the player. Then, once an award is generated, the corresponding cube (e.g., 500) 790-1 rotates into the blender 810 so that the player may view the same. While in the blender 810 the cube descends and then rotates back out of view.

FIGS. 30*a-d* and 31*a-f* show yet another mechanical embodiment comprising a rotatable tray 820 positioned adjacent to a blender or glass 830. Individual sections 840 of the tray 820 each contain a single cube 850 having a different numeral depicted thereon. Once an award is randomly generated, the tray 820 rotates to position the corresponding cube 850-1 adjacent to the glass 830. Then, a door 860 separating the tray 820 and glass 830 opens and an air source, spring or similar means acts upon the cube 850-1 to force it into the glass 830. Ideally, the cube 850-1 bounces energetically inside the glass 830 like an ice cube dropped in a glass. A rotatable ramp 865 on the bottom of the glass 830 rotates in an upward direction to cause the cube 850-1 to return to its section 840 on the tray 820. In this embodiment, like others, a portion of the glass 830 extends beyond a machine housing such that the cube 850-1 exits the player housing. Therefore, the glass 830 incorporates a lid (not shown) to prevent player interference. This mechanical embodiment may also be used in combination with the embodiments shown in FIGS. 10-11, 22 and 23-*a-d* to select and display the correct cube in conjunction with the mechanical activities designed to fool the player into believing the selected and displayed cube is random.

FIGS. 32*a-f* show yet another mechanical embodiment comprising an upper conveyor belt section 870 and lower conveyor belt section 880. Cubes 890 are aligned on the upper conveyor belt section 870 and dropped through a guide member 885 into a blender or glass 900. In this manner, the cubes 890 are placed in a pre-established order which is repeated after a complete cycle of cubes 890 are dropped into the glass 900. After a pre-determined and brief time period, the lower conveyor belt section 910 receives the dropped cubes 890 from a door or similar access panel 905 and chute 910 and transports them back to the upper conveyor belt section 870. To enhance this embodiment, multiple glasses and conveyor systems may be incorporated into a single a gaming machine. Multiple glasses and conveyor systems would allow for more unique and random appearing awards. In an alternative conveyor alternative embodiment, shown in FIGS. 33*a-e*, blank and transparent cubes 920 fall into the blender or glass 900 and have numerals projected thereon by a series of projectors 930 positioned behind said glass or blender 900.

Figure 34:
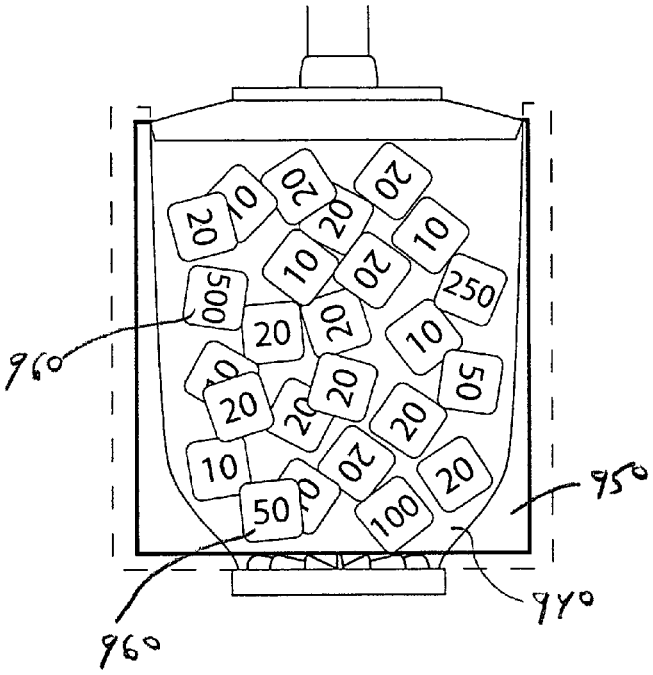
FIGS. 34-35 show an alternative mechanical embodiment of the present invention.
Figure 35:
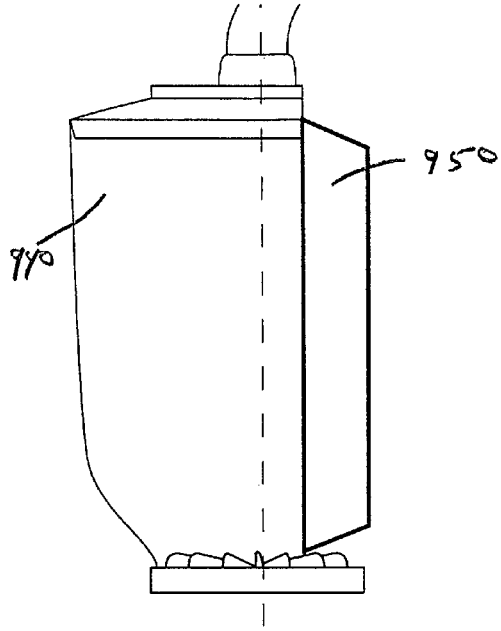

FIGS. 34-35 shows another video embodiment comprising a physical blender 940 in combination with a video monitor 950. The video monitor 950 displays cubes 960 depicting numerals 970. The video monitor 950 provides a great deal of versatility and permits an easy mechanism for displaying simulated ice cubes.

Figure 39:
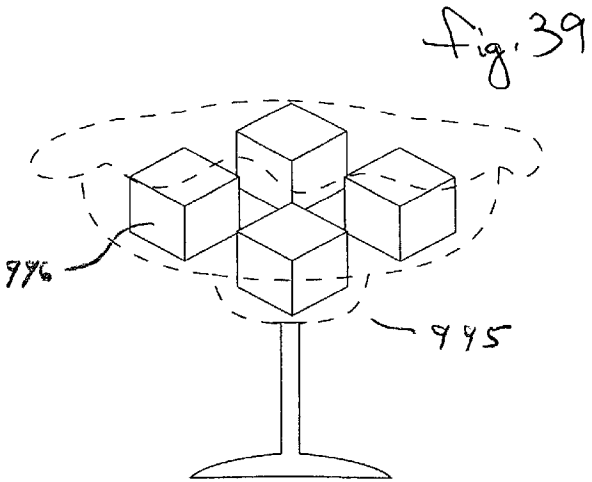
FIGS. 38-40 show an alternative mechanical embodiment of the present invention.
Figure 38:
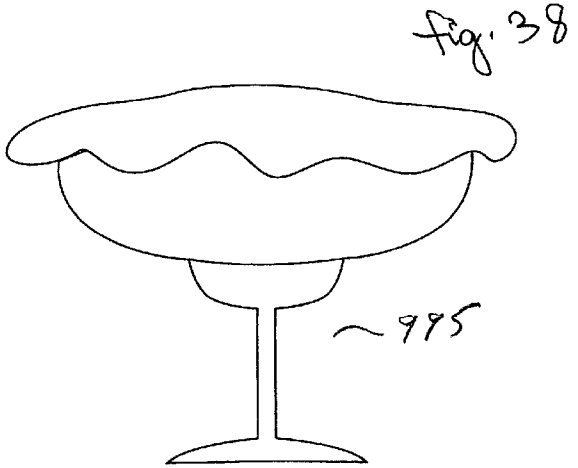
Figure 40:
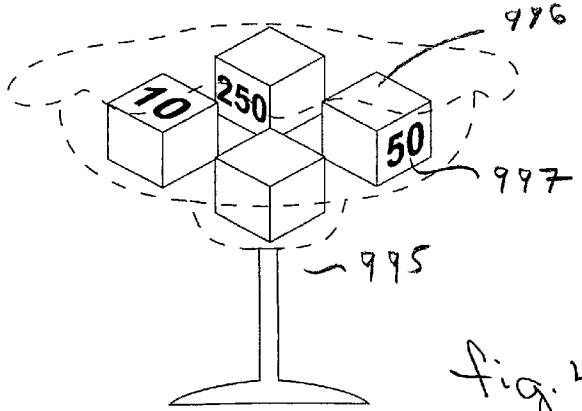
Figure 41:
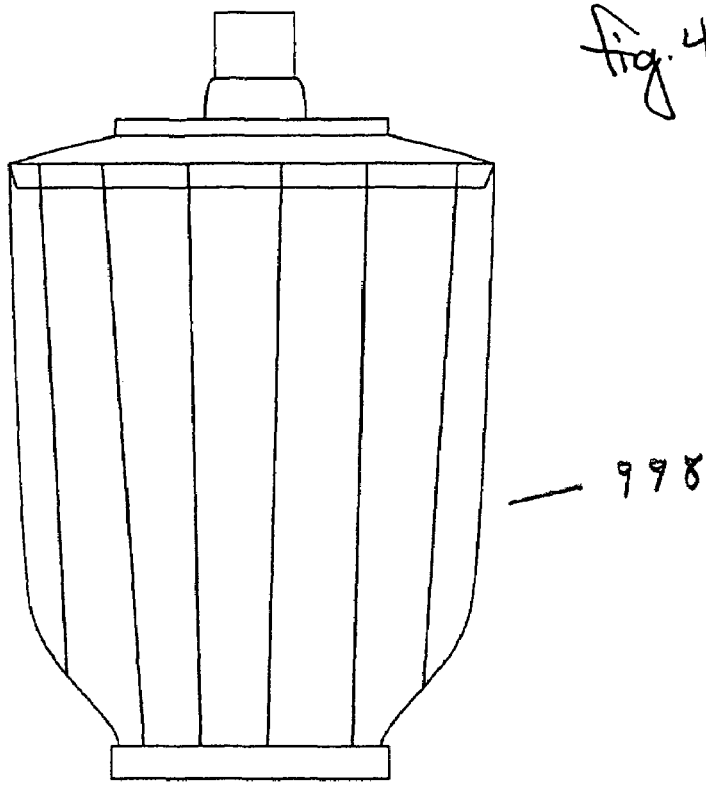
FIGS. 41-42 shows a contoured blender design.
Figure 42:
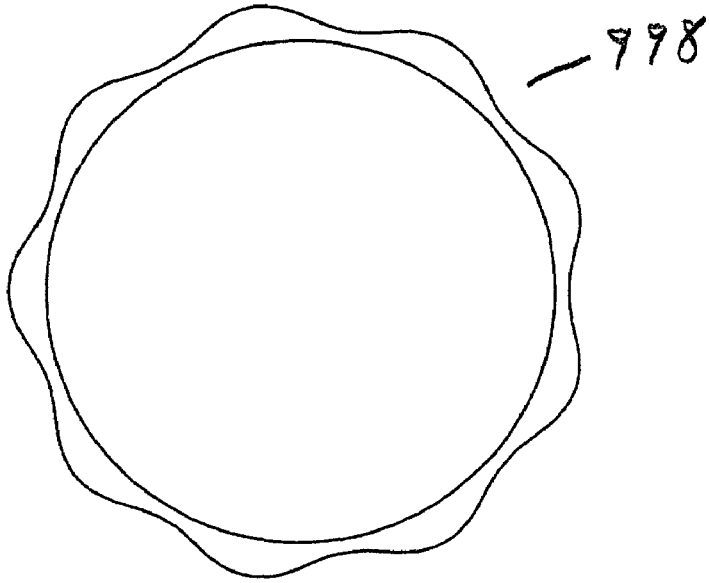

The embodiments of the present invention may be further enhanced by several optional features. As shown in FIGS. 36*a-d* and 37*a-d*, the blender 980 or glass may have an inside wall 985 and outside wall 990 defining a space for containing liquid 986. An opaque liquid may be used to conceal blender operations until such time that awards have been identified. Transparent liquids may also be used. FIGS. 38-40 show a drink glass 995 containing fixed cubes 996. The cubes 996 are illuminated and display an appropriate award 997 via an LED or the like. During idle time, the cubes 996 are hidden from view as illustrated in FIG. 38. FIGS. 41-42 show a contoured blender design 998. The contours assist in concealing the activities within the blender to enhance the appearance that a cube has been selected from within the blender 550. Another feature permits the player to control the speed of the blender 550. A control interface (not shown) may comprise buttons or switches integrated on the gaming machine. Accordingly, once a primary game award is won, the machine prompts the player to activate the blender, including its speed.

Even though the embodiments of the present invention have been described as a secondary game, they may also be implemented as the primary game.

Although the invention has been described in detail with reference to a preferred embodiment, additional variations and modifications exist within the scope and spirit of the invention as described and defined in the following claims.

I claim:

1. An electronic gaming machine comprising;

a primary game including one or more gaming indicia; a secondary game in communication with said primary game comprising mechanical means for causing one or more award indicators in the form of physically embodied simulated ice cubes to be individually and visually presented in a container to a gaming machine player wherein said means for causing said one or more award indicators in the form of simulated ice cubes to be visually presented to a gaming machine player comprises one or more projectors positioned adjacent to the container, said secondary game activated in response to a pre-established primary game outcome; and wherein said awards depicted on the simulated ice cubes aid in determining a secondary game award.

2. The gaming machine of claim 1 wherein the one or more projectors project numerals or symbols onto cubes deposited into the container.

3. The gaming machine of claim 1 wherein said container has an outer wall and inner wall defining a space containing a selectable amount liquid.

4. The gaming machine of claim 3 wherein the liquid is opaque to conceal an inner portion of the container.

5. An electronic gaming machine comprising;

a primary game including one or more gaming indicia; a secondary game in communication with said primary game comprising mechanical means for causing one or more award indicators in the form of physically embodied simulated ice cubes to be individually and visually presented in a container to a gaming machine player, said container having an outer wall and inner wall defining a space containing a selectable amount liquid, said secondary game activated in response to a pre-established primary game outcome; and wherein said awards depicted on the simulated ice cubes aid in determining a secondary game award.

6. The gaming machine of claim 5 wherein the liquid is opaque to conceal an inner portion of the container.

* * * * *